United States Patent [19]

Steinberg

[11] Patent Number: 4,467,799

[45] Date of Patent: Aug. 28, 1984

[54] TRANSPARENT ODOR-FREE FACE MASK

[76] Inventor: Jacob H. Steinberg, 2631 E. West Hwy., Chevy Chase, Md. 20815

[21] Appl. No.: 369,922

[22] Filed: Apr. 19, 1982

Related U.S. Application Data

[63] Continuation-in-part of Ser. No. 146,439, May 5, 1980, abandoned.

[51] Int. Cl.[3] ..... A62B 7/10

[52] U.S. Cl. ..... 128/206.14; 128/206.25; 128/206.19

[58] Field of Search ..... 128/206.12–207.13, 128/203.29; 428/307; 604/333, 337, 344, 358, 359

[56] References Cited

U.S. PATENT DOCUMENTS

| | | | |
|---|---|---|---|
| 443,191 | 12/1890 | Illing | 55/279 |
| 838,434 | 12/1906 | Morgan | 55/279 |
| 2,921,581 | 1/1960 | Swearingen et al. | 128/206.25 |
| 2,988,461 | 6/1961 | Eichel | 117/122 |
| 3,116,969 | 1/1964 | Coleman, Jr. | 55/279 |
| 3,695,265 | 10/1972 | Brevik | 128/206.14 |
| 4,186,743 | 2/1980 | Steiger | 604/344 |
| 4,215,682 | 8/1980 | Kubik et al. | 128/206.19 |
| 4,240,420 | 12/1980 | Riaboy | 128/206.14 |
| 4,269,315 | 5/1981 | Boyce | 128/206.19 |
| 4,328,797 | 5/1982 | Rollins et al. | 128/205.25 |

*Primary Examiner*—Henry J. Recla

*Attorney, Agent, or Firm*—Jacob A. Steinberg

[57] ABSTRACT

A hygienic, disposable, cup shaped, thin, flexible transparent face mask to cover the mouth and nose area of the face of a wearer comprising a transparent foraminous web having a narrow circuitous edging on the back of which there is applied at least 3 relatively equidistant spots of rupturable pressure-sensitive adhesive wherein the composition of said face mask includes a transparent bactericide and a transparent deodorant.

1 Claim, 2 Drawing Figures

TRANSPARENT ODOR-FREE FACE MASK

Figure 1:
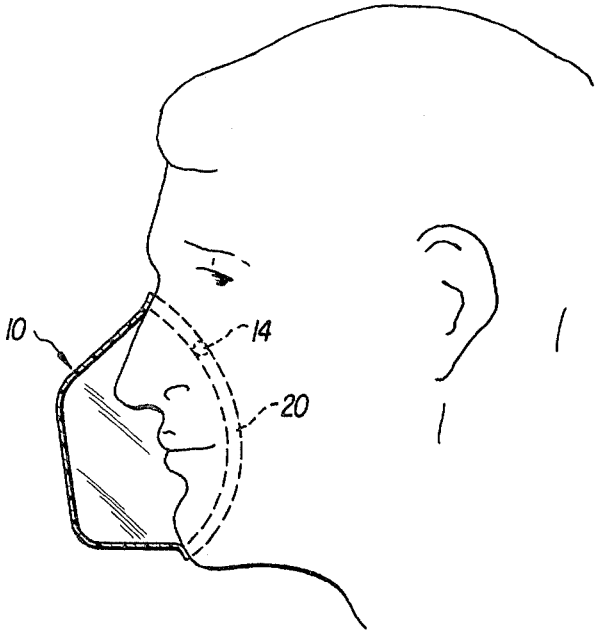

This Application is a continuation-in-part of Application Ser. No. 146,439 filed on 5/05/80 and abandoned by applicant's failure to respond to the office action of July 23, 1981.

This invention relates to a face mask that is both inexpensive and disposable and wherein provision is made for easy breathing, transparency, lightweightedness, hygienicness, along with facility of easy application and removal.

The need for such a face mask is universally recognized. In the major cities of the world, crowds of people are congregated and are so contiguous to each other that oral bacteria are easly passed from one to the other. Only a properly constructed mask with ease of application and removal and one that is transparent and hard to notice would serve this universal need.

In the prior art, such as shown by Krautz U.S. No. 3,438,370, such masks are made of gauze cloth, celluloid, or resin and they are kept in place by ugly looking tie backs of wire bows or in some cases by circuitous opaqued pressure sensitive adhesive which can obviously be noticed.

It is therefore and important object of this invention to eliminate these ugly tie backs or wire bows, with transparent pressure-sensitive spots of adhesive for attaching the mask to the face of the wearer so that the mask cannot be noticed.

Another object is to use transparent compositions to make the mask so as to render it so transparent that it becomes unnoticeable.

Another object is to include in the composition of the mask, either by coating or impregnating a deodorant and a bacteriocide.

A further object is to so construct the masks as to make them nestable for boxing.

A further object is to make a face mask that is light in weight, flexible and relatively invisible and being not only hygienic but also odor-free.

A further object is to make a mask that is relatively easy to apply or remove and is so economical as to be disposable for any individual that wishes complete protection from a crowd or wants to protect others from his oral germs. It would also be helpful and economical for professionals such as doctors, dentists, nurses, teachers, beauticians, barbers, and numerous other person-to-person situations.

A review of the prior art of Dental Masks in Class 128, Subclass 139 discloses dental masks made of gauze, filter paper, celluloid, and plastic. The means used to hold the mask in place on the face of the wearer are unsightly tie-backs, strings, spring wire ear bows, and opaque pressure sensitive adhesive. All of these masks have the same characteristic of being easily seen and therefore embarrassing to the wearer. The instant invention avoids this embarrassment of the wearer by constructing a face mask with only invisible materials and transparent aqueous solutions of antibiotics and odor masking compositions and a transparent resin. The attachment means consist of three or four relatively transparent equidistantly spaced spots of transparent pressure sensitive adhesive located around the perifery of the mask. The foraminous mask is made by spraying threads of thin, flexible, transparent resin such as vinyl or acrylic resin in such a manner as to criss-cross spray heads to finally yield a foraminous non-woven web.

Included in such resin are bacteriocidal and an aqueous ingredients of a bacteriocide and of a deodorant composition. Another method is to use a thin transparent flexible web sheet of resin material which after being coated with the aqueous solution of a bacteriocide and an odor masking material is punctured during the molding process. This thin flexible foraminous resin web is then shaped into an arcuate cup shape having a flat thin border edging surrounding said web. For a beardless person, there are placed four equidistant spots of transparent pressure sensitive adhesive applied on the underside of the edging which are then pressed on the face of a wearer at the top of the nose area, the two cheek bone areas, and the chin area. For a bearded person, the chin area spot of adhesive would bot be activated since the three remaining spots if activated would be sufficient to hold the mask in place. The spots of transparent pressure sensitive adhesive which are included are in the form of microballoons or spots covered with a rupturable coating of transparent resin. The reason for employing microballoon spots of pressure sensitive adhesive is to assure pinpoint adherence of the adhesive with the simple pressure of a thumb. Restriction to so small an area of adhesion makes it easier to apply or remove the mask.

Figure 2:
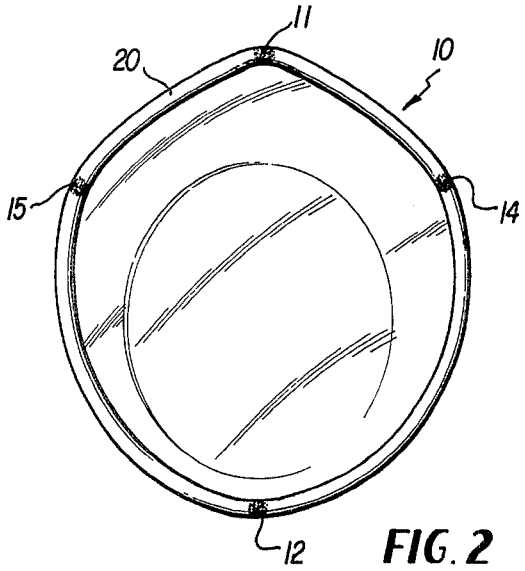

Other and further important objects will be apparent from the following description, taken in conjunction with the accompanying drawings in which:

FIG. 1 is a profile view of the face of a wearer with the mask shown in place thereon; and FIG. 2 is a plan view looking into the inside of the mask.

The mask 10 is attached to the face by means of pressure sensitive adhesive spots located as shown in FIG. 2 by numerals 11 and 12 on top and bottom and on the sides by numerals 14 and 15. These spots of pressure sensitive adhesive are encapsulated in transparent resinous microballoons. When pressed, these balloons break and exude the pressure sensitive adhesive. In lieu of microballoons, the adhesive may be applied as spots and then coated with a fracturable coating. The resins used are transparent and could include the acrylates, the styrenes, the polyvinyl chlorides, the polyamides, the polyolefins, the vinyls, the fluorocarbons, the polycarbonates, the cellulosic acetates and also thermosetting resins. A foraminous sheet of resin is first formed by oscillating spray guns back and forth to form a whole series of criss-cross threads of resin so as to form a non-woven thread-like thin flexible foraminous web. This web is then heat pressured between suitable molds so as to form an acruately cupped face mask having a narrow circuitous flat edging 20 upon which the spots of adhesive are applied. Another method of making the foraminous web is to use a sheet of thin flexible resin fed from a roller and passing this sheet to the shaping steps which can include piercing means to provide perforations for breathing during the molding step. Note that when the spots of adhesive are pressed, the pressure sensitive adhesive attaches to the face at four minimal spot areas. One at the top of the nose, two at the cheekbones and one on the chin area which would bot be activated when used by a bearded wearer.

For hygienic purposes, a bacteriocide is either incorporated in the resin spray or applied as a coating on the foraminous sheet before molding the mask. Examples of suitable bacteriocides are hexachlorophene, tetramethylthiaramdisulfide and 2,2' thiobis. The deodorant can be similarly incorporated in the mask. An example of suitable deodorant is a heterocyclic quarternary ammonium compound.

It is further stressed that all resins used for the masks and the adhesive, as well as the ingredients, are all transparent so as to make the mask as unnoticable as possible when in use. One of the chief reasons for reticense on the part of a wearer in using a face mask is its noticeability by an onlooker. This factor which is embarrassing to a wearer is solved by the transparent mask of this invention. An additional advantage is ease of application and removal. With a low cost of production, its' cost makes it disposable for each individual use. Making it germ proof and odor-free lends it utility in large cities where crowds of people usually congretate. Wearing the mask of this invention would undoubtedly reduce the transference of a myriad of oral bacteria. This mask could ameliorate some of the sufferings of the common cold, which is often carried into a theatre, a subway, a department store at at a barber shop of beauty parlor. The fact that this mask is unnoticeable because of its transparency would obviate the embarrassment of the wearer whether he be a doctor, dentist, nurse, pedestrian, teacher or anyone whose breath is to be protected from contamination or who wishes to keep his oral bacteria to himself.

It will be understood that modifications and variations may be effected without departing from the scope of the novel concepts of the present invention.

What is claimed is:

1. A dental mask structured to overcome a wearer's reticenes in wearing it which includes a thin, foraminous, transparent, thermoplastic and resinous sheet which has been treated with an aqueous transparent coating of an odor masking coating and an aqueous transparent coating of a bacteriocide which is then perforated while being molded into an inverted C-cup shape having a narrow outwardly flanged border on its periphery which is adapted to fit over the oronasal regions of the wearer's face, said border has applied to its back surface 3 spots of transparent pressure sensitive adhesive enclosed in transparent microballoons of resin to permit thumb pressure so as to apply a minimum of adhesive to attach said mask at 3 points of the face of a wearer, one at the bridge of the nose and one at each of the 2 cheeks of a wearer.

* * * * *